US011226127B2

(12) United States Patent
Matsumoto

(10) Patent No.: US 11,226,127 B2
(45) Date of Patent: Jan. 18, 2022

(54) CONTROL SYSTEM, AIR CONDITIONER, AND SERVER

(71) Applicant: Mitsubishi Electric Corporation, Tokyo (JP)

(72) Inventor: Takashi Matsumoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/768,372

(22) PCT Filed: Jan. 26, 2018

(86) PCT No.: PCT/JP2018/002470
§ 371 (c)(1),
(2) Date: May 29, 2020

(87) PCT Pub. No.: WO2019/146067
PCT Pub. Date: Aug. 1, 2019

(65) Prior Publication Data

US 2020/0370779 A1 Nov. 26, 2020

(51) Int. Cl.
*F24F 11/00* (2018.01)
*F24F 11/63* (2018.01)
(Continued)

(52) U.S. Cl.
CPC ..... *F24F 11/63* (2018.01); *F24F 11/58* (2018.01); *F24F 2110/12* (2018.01);
(Continued)

(58) Field of Classification Search
CPC ..... F24F 11/63
See application file for complete search history.

(56) References Cited

U.S. PATENT DOCUMENTS

2014/0365017 A1* 12/2014 Hanna ..... F24F 11/30 700/276
2016/0201933 A1* 7/2016 Hester ..... G05B 15/02 700/276
(Continued)

FOREIGN PATENT DOCUMENTS

CN 1884934 A 12/2006
CN 104854521 A 8/2015
(Continued)

OTHER PUBLICATIONS

Chinese Office Action dated Mar. 17, 2021, issued in corresponding Chinese Patent Application No. 201880087212.4 (and English Machine Translation).
(Continued)

*Primary Examiner* — Mark A Connolly
(74) *Attorney, Agent, or Firm* — Posz Law Group, PLC

(57) ABSTRACT

In a control system, a heat load estimation unit, by referring to location information that indicates a location environment of a house H1 and to weather information that indicates a weather forecast for a certain time slot T1, estimates a heat load which depends on solar radiation to the house H1 during the time slot T1. Specifically, the heat load estimation unit checks whether or not there is a building that blocks the solar radiation to the house H1 during the time slot T1 based on the location information when the weather forecast indicated in the weather information is sunny. Further, the heat load estimation unit estimates the heat load which depends on the solar radiation to the house H1 during the time slot T1 according to a result of the check. An operation control unit controls ahead, operation of an air conditioner provided in the house H1 before the time slot T1 according to the heat load estimated by the heat load estimation unit.

9 Claims, 5 Drawing Sheets

(51) Int. Cl.

| | |
|---|---|
| ***F24F 11/58*** | (2018.01) |
| *F24F 130/20* | (2018.01) |
| *F24F 140/50* | (2018.01) |
| *F24F 130/10* | (2018.01) |
| *F24F 110/12* | (2018.01) |

(52) U.S. Cl.
CPC ..... *F24F 2130/10* (2018.01); *F24F 2130/20* (2018.01); *F24F 2140/50* (2018.01)

(56) References Cited

U.S. PATENT DOCUMENTS

| | | | |
|---|---|---|---|
| 2017/0051937 | A1 | 2/2017 | Toyoshima et al. |
| 2017/0211830 | A1 | 7/2017 | Kosaka et al. |
| 2017/0315697 | A1* | 11/2017 | Jacobson ..... H04L 12/2816 |
| 2019/0318047 | A1 | 10/2019 | Kogo |

FOREIGN PATENT DOCUMENTS

| | | | |
|---|---|---|---|
| JP | 2002-004403 | A | 1/2002 |
| JP | 2006-050524 | A | 2/2006 |
| JP | 2006-246674 | A | 9/2006 |
| JP | 2007-003096 | A | 1/2007 |
| JP | 2007-004662 | A | 1/2007 |
| JP | 2009-210237 | A | 9/2009 |
| JP | 2010-134367 | A | 6/2010 |
| JP | 4500602 | B2 | 7/2010 |
| JP | 2010-242487 | A | 10/2010 |
| JP | 2013-037523 | A | 2/2013 |
| JP | 5570847 | B2 | 8/2014 |
| JP | 2014-191582 | A | 10/2014 |
| JP | 2015-166643 | A | 9/2015 |
| JP | 2016-094715 | A | 5/2016 |
| JP | 6135129 | B | 5/2017 |
| JP | 2017-133707 | A | 8/2017 |
| WO | 2014/074308 | A1 | 5/2014 |
| WO | 2015/170414 | A1 | 11/2015 |
| WO | 2017/217131 | A1 | 4/2019 |

OTHER PUBLICATIONS

European Search Report dated Apr. 13, 2021, issued in corresponding European Patent Application No. 18902994.5.

Johannes Horak et al., "Cabin air temperature of parked vehicles in summer conditions: life-threatening environment for children and pets calculated by a dynamic model," SpringerLink.com, Jul. 18, 2016, 12 pages.

International Search Report of the International Searching Authority dated Jan. 5, 2018 for the corresponding International application No. PCT/JP2018/002470 (and English translation).

European Search Report dated Jul. 20, 2021, issued in corresponding European Patent Application No. 18902994.5.

Office Action dated Sep. 7, 2021, issued in corresponding JP Patent Application No. 2019-567489 (and English machine translation).

* cited by examiner

CONTROL SYSTEM, AIR CONDITIONER, AND SERVER

CROSS REFERENCE TO RELATED APPLICATION

This application is a U.S. national stage application of International Application No. PCT/JP2018/002470, filed on Jan. 26, 2018, the contents of which are incorporated herein by reference.

TECHNICAL FIELD

The present invention relates to a control system, an air conditioner, and a server.

BACKGROUND

A consumption ratio of electric power required for operating an air conditioner is generally largest in a compressor. Therefore, efficiency of the compressor greatly affects energy conservation of the air conditioner. In recent years, because more houses are becoming highly airtight and highly insulated, frequency of operation in a low load area is increasing. Especially, the importance of operation efficiency of the compressor during low speed operation of the compressor is increasing. It does not mean, however, that there is no need for high capacity which is increasing rotation speed of the compressor to a maximum at rapid startup of cooling in intense heat or at rapid startup of heating in frigid outdoor air. That is, there is a demand for air conditioners in recent years to satisfy both extremes, energy conservation in a low load area and high capacity in a high load area.

In patent literature 1, technology regarding a connection method of a winding of an electric motor to switch to a star connection at low speed operation and switch to a delta connection at high speed operation to attempt to achieve both high efficiency of operation and enlarging a range of movement of the compressor, is described.

PATENT LITERATURE

Patent Literature 1: JP 2006-246674 A

There is also a demand for the air conditioner to reduce deterioration of comfort due to changes in a heat load inside a house. How much sunlight a house receives is affected by location environment such as whether or not a large building is adjacent. Although more houses are becoming highly airtight and highly insulated, changes in heat load owing to solar radiation cannot be ignored.

With conventional art, it is difficult to reduce deterioration of comfort caused by changes in a heat load due to the solar radiation.

SUMMARY

The present invention aims to reduce deterioration of comfort caused by changes in a heat load due to the solar radiation.

A control system according to one aspect of the present invention includes:

a heat load estimation unit, by referring to location information that indicates a location environment of a house and to weather information that indicates a weather forecast for a certain time slot, to estimate a heat load which depends on solar radiation to the house during the time slot; and an operation control unit to control ahead, operation of an air conditioner provided in the house before the time slot according to the heat load estimated by the heat load estimation unit.

In the present invention, the operation of the air conditioner is controlled according to a result of an estimation of the heat load due to the solar radiation. As a result, the deterioration of comfort caused by changes in the heat load due to the solar radiation can be reduced.

DETAILED DESCRIPTION

Figure 1:
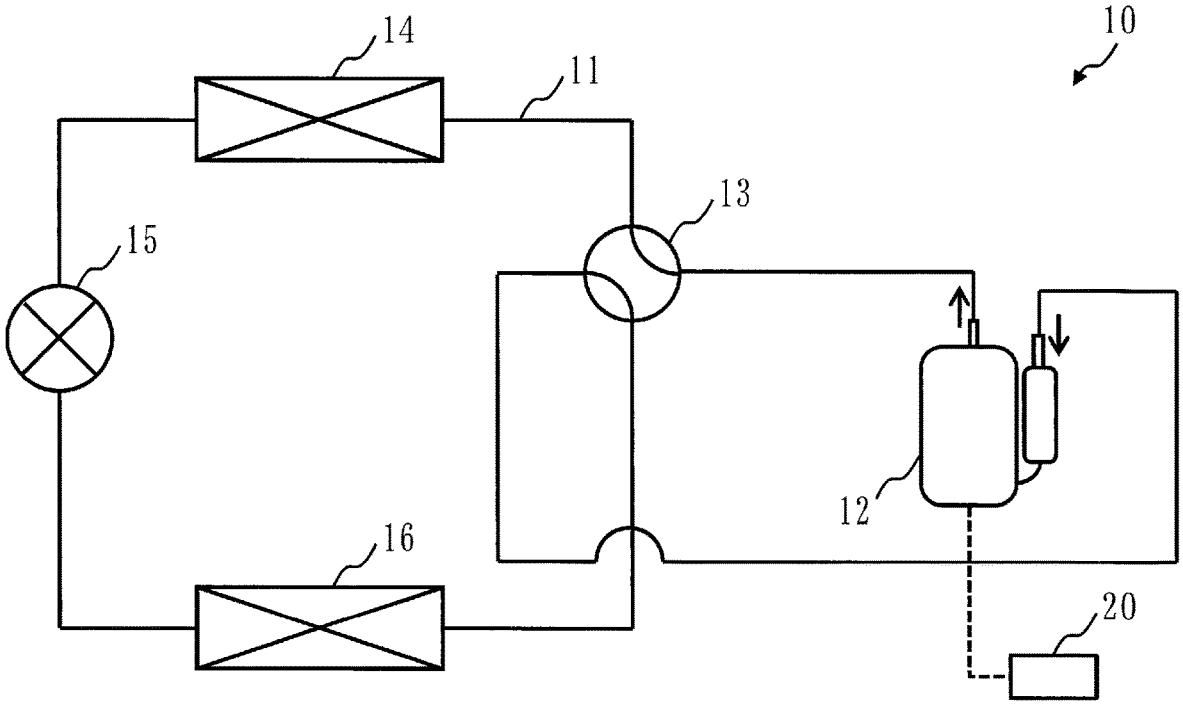
FIG. 1 is a circuit diagram illustrating a configuration of an air conditioner according to Embodiment 1.

Hereinafter, embodiments of the present invention will be described, using the drawings. The same or equivalent portions are denoted by the same reference numerals throughout the respective drawings. Explanations of the same or equivalent portions will be suitably omitted or simplified in the description of the embodiments. Note that the present invention is not limited to the embodiments to be described hereinafter, and various modifications are possible as necessary. For example, two or more embodiments of the embodiments to be described hereinafter may be implemented in combination. Alternatively, one embodiment or a combination of two or more of the embodiments to be described hereinafter may be partially implemented.

Embodiment 1

This embodiment will be described using FIGS. 1 to 4.

*Description of Configuration*

A configuration of an air conditioner 10 according to this embodiment will be described by referring to FIGS. 1 and 2.

FIG. 1 illustrates a refrigerant circuit 11 during cooling operation. FIG. 2 illustrates the refrigerant circuit 11 during heating operation.

The air conditioner 10 includes the refrigerant circuit 11 where a refrigerant circulates. The air conditioner 10 further includes a compressor 12, a four-way valve 13, a first heat exchanger 14 which is an outdoor heat exchanger, an expansion mechanism 15 which is an expansion valve, and a second heat exchanger 16 which is an indoor heat exchanger. The compressor 12, the four-way valve 13, the first heat exchanger 14, the expansion mechanism 15, and the second heat exchanger 16 are connected to the refrigerant circuit 11.

The compressor 12 compresses the refrigerant. The four-way valve 13 switches a flow direction of the refrigerant in accordance with the cooling operation and the heating operation. The first heat exchanger 14 operates as a condenser during the cooling operation, and dissipates heat of the refrigerant compressed by the compressor 12. That is, the first heat exchanger 14 performs heat exchange using the refrigerant compressed by the compressor 12. The first heat exchanger 14 operates as an evaporator during the heating operation, and heats the refrigerant by exchanging heat between outdoor air and the refrigerant expanded by the expansion mechanism 15. The expansion mechanism 15 expands the refrigerant the heat of which has been dissipated in the condenser. The second heat exchanger 16 operates as a condenser during the heating operation, and dissipates heat of the refrigerant compressed by the compressor 12. That is, the second heat exchanger 16 performs heat exchange using the refrigerant compressed by the compressor 12. The second heat exchanger 16 operates as an evaporator during the cooling operation, and heats the refrigerant by performing heat exchange between indoor air and the refrigerant expanded by the expansion mechanism 15.

The air conditioner 10 further includes a control system 20.

Figure 2:
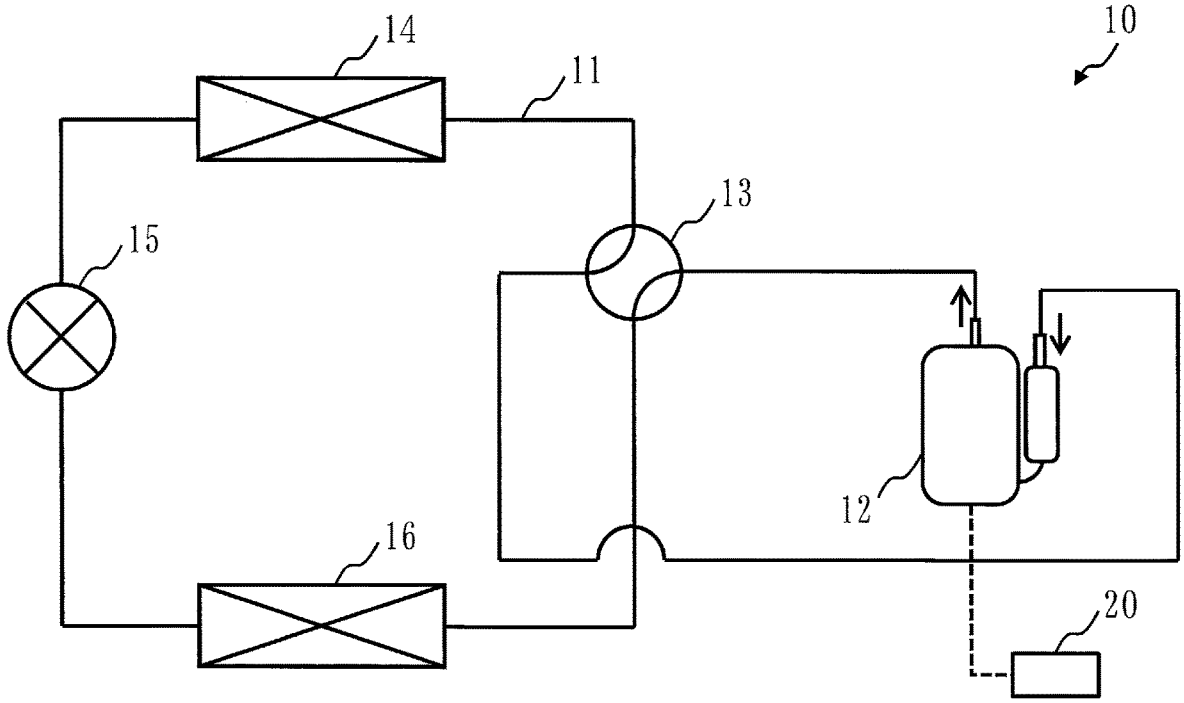
FIG. 2 is a circuit diagram illustrating a configuration of an air conditioner according to Embodiment 1.

Although FIGS. 1 and 2 illustrate only a connection between the control system 20 and the compressor 12, the control system 20 may be connected not only to the compressor 12, but also to an element connected to the refrigerant circuit 11, other than the compressor 12. The control system 20 monitors and controls state of each element connected to the control system 20.

Figure 3:
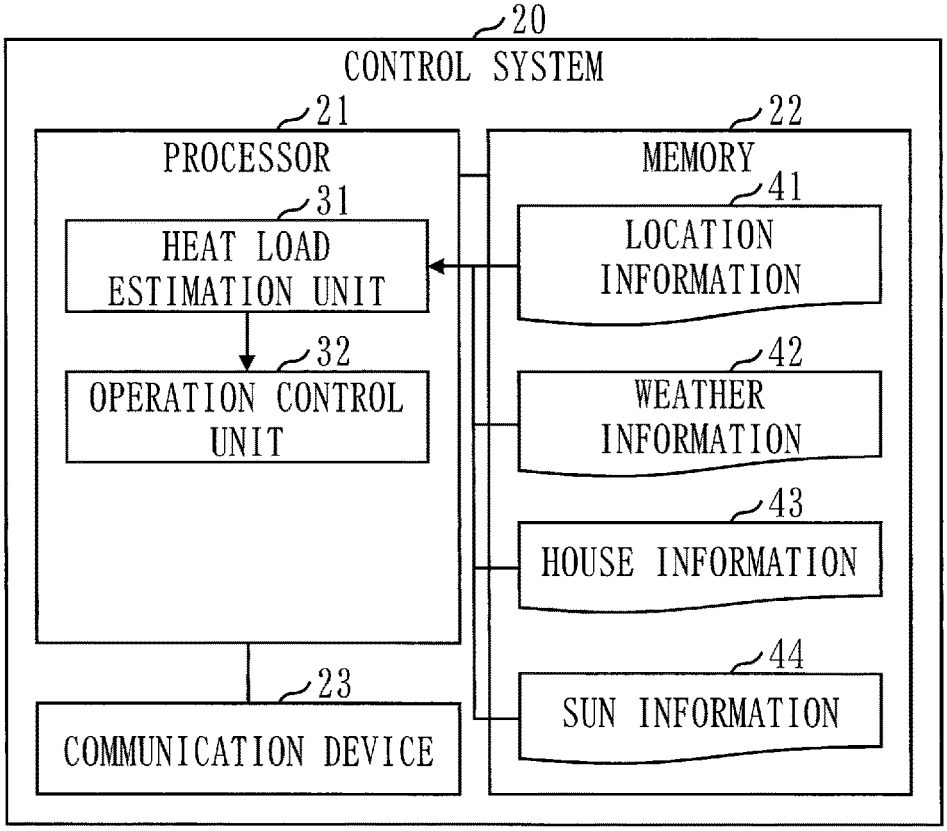
FIG. 3 is a block diagram illustrating a configuration of a control system according to Embodiment 1.

A configuration of the control system 20 according to this embodiment will be described by referring to FIG. 3.

The control system 20 is a computer. Specifically, the control system 20 is a microcomputer. The control system 20 includes a processor 21 as well as other hardware such as a memory 22 and a communication device 23. The processor 21 is connected to other hardware via signal lines and controls these other hardware.

The control system 20 includes, as functional elements, a heat load estimation unit 31 and an operation control unit 32. Functions of the heat load estimation unit 31 and the operation control unit 32 are realized by software.

The processor 21 is a device that executes a control program. The control program is a program that realizes functions of the heat load estimation unit 31 and the operation control unit 32. The processor 21 is, for example, a CPU. "CPU" is an abbreviation for Central Processing Unit.

The memory 22 is a device that stores the control program. The memory 22 is, for example, a RAM, a flash memory, or a combination of these. "RAM" is an abbreviation for Random Access Memory.

Location information 41, weather information 42, house information 43, and sun information 44 to be described later are stored in the memory 22.

The communication device 23 includes a receiver that receives data inputted into the control program and a transmitter that transmits data outputted from the control program. The communication device 23 is, for example, a communication chip or an NIC. "NIC" is an abbreviation for Network Interface Card.

The control program is read into the processor 21 from the memory 22, and is executed by the processor 21. Not only the control program, but also an OS is stored in the memory 22. "OS" is an abbreviation for Operating System. The processor 21 executes the control program while executing the OS. A part or all of the control program may be built into the OS.

The control system 20 may include a plurality of processors that substitute for the processor 21. These plurality of processors share the execution of the control program. Each processor is, for example, a CPU.

Data, information, signal values, and variable values used, processed, or outputted by the control program are stored in the memory 22 or in a register or a cache memory in the processor 21.

The control program is a program that makes a computer execute processes performed by the heat load estimation unit 31 and the operation control unit 32 as a heat load estimation process and an operation control process, respectively. The control program may be provided being recorded in a computer-readable medium, may be provided being stored in a recording medium, or may be provided as a program product.

The control system 20 may be configured of one computer or may be configured of a plurality of computers. If the control system 20 is configured of a plurality of computers, functions of the heat load estimation unit 31 and the operation control unit 32 may be realized by being distributed to each computer.

*Description of Operation*

Figure 4:
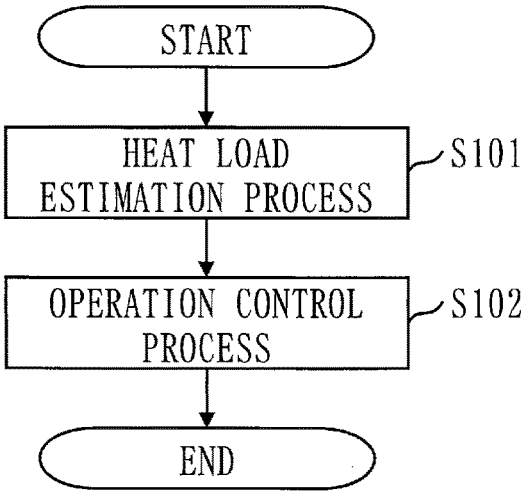
FIG. 4 is a flowchart illustrating operation of a control system according to Embodiment 1.

Operation of the control system 20 according to this embodiment will be described by referring to FIG. 4. The operation of the control system 20 corresponds to a control method according to this embodiment.

At step S101, the heat load estimation unit 31 estimates a heat load which depends on solar radiation to a house H1 during a time slot T1 by referring to the location information 41 that indicates a location environment of the house H1 and the weather information 42 that indicates a weather forecast for a certain time slot T1. The time slot T1 is, in this embodiment, a specific time such as time from 12:00 to 13:00, but the time slot T1 may be a specific short term shorter than one hour such as from 12:00 to 12:30, or may be a specific long term longer than one hour such as from 12:00 to 15:00.

Specifically, the heat load estimation unit 31 checks from the location information 41, whether or not there is a building blocking the solar radiation to the house H1 during the time slot T1 when the weather forecast indicated in the weather information 42 is sunny. Then, the heat load estimation unit 31 estimates the heat load which depends on the solar radiation to the house H1 during the time slot T1 according to the result of the check.

More specifically, the heat load estimation unit 31 reads the weather information 42 from the memory 22. The weather information 42 is obtained as appropriate from an external server via the Internet by the communication device 23, and stored in the memory 22. The heat load estimation unit 31 specifies the weather forecast for the time slot T1 of the day from the weather information 42 read. If the weather forecast for the time slot T1 of the day is sunny, the heat load estimation unit 31 reads the location information 41 from the memory 22. The location information 41 is stored in the memory 22 beforehand and is updated as appropriate. The heat load estimation unit 31 checks from the location information 41 read whether or not a building exists around the house H1, and whether or not the building that exists around the house H1 blocks the solar radiation to the house H1 during the time slot T1 of the day. If a building exists around the house H1 and the building blocks the solar radiation to the house H1 during the time slot T1 of the day, the heat load estimation unit 31 estimates the heat load which depends on the solar radiation to the house H1 during the time slot T1 of the day to be somewhat low. When the weather forecast for the time slot T1 of the day is other than sunny as well, the heat load estimation unit 31 estimates the heat load which depends on the solar radiation to the house H1 during the time slot T1 of the day to be somewhat low. On the other hand, if the weather forecast for the time slot T1 of the day is sunny and a building does not exist around the house H1, the heat load estimation unit 31 estimates the heat load which depends on the solar radiation to the house H1 during the time slot T1 of the day to be somewhat high. When the weather forecast for the time slot T1 of the day is sunny and a building that exists around the house H1 does not block the solar radiation to the house H1 during the time slot T1 of the day as well, the heat load estimation unit 31 estimates the heat load which depends on the solar radiation to the house H1 during the time slot T1 of the day to be somewhat high. As for an estimation method of the heat load, an arbitrary method may be used, but in this embodiment, a method is used where a standard value of the heat load during the time slot T1 on a sunny day and a standard value of the heat load during the time slot T1 on a day other than a sunny day is set beforehand, as a first standard value and a second standard value, respectively, and either one of the standard values is selected. That is, when the heat load is to be estimated somewhat high, the heat load estimation unit 31 selects the first standard value. When the heat load is to be estimated somewhat low, the heat load estimation unit 31 selects the second standard value.

In this embodiment, information that indicates a position Pb of the building that exists around the house H1 is included in the location information 41. If the weather forecast indicated in the weather information 42 is sunny, the heat load estimation unit 31 checks whether or not there is a building that blocks the solar radiation to the house H1 during the time slot T1 by referring to the house information 43 that indicates a position Ph of the house H1 and to the sun information 44 that indicates a direction of the sun during the time slot T1, other than the location information 41.

Specifically, if the weather forecast for the time slot T1 of the day is sunny, the heat load estimation unit 31 reads the location information 41 from the memory 22. The heat load estimation unit 31 checks whether or not a building exists around the house H1 from the location information 41 read. If a building exists around the house H1 the heat load estimation unit 31 reads the house information 43 and the sun information 44 from the memory 22. The house information 43 is stored in the memory 22 beforehand. In this embodiment, the sun information 44 is stored in the memory 22 beforehand, but the sun information 44 may be generated when the direction of the sun is calculated from other information and stored in the memory 22. The heat load estimation unit 31 specifies the direction of the sun during the time slot T1 of the day from the sun information 44 read. The heat load estimation unit 31 checks whether or not the position Pb indicated in the location information 41 read is in the direction of the sun during the time slot T1 of the day viewed from the position Ph indicated in the house information 43. If the position Pb is in the direction of the sun during the time slot T1 of the day viewed from the position Ph, the heat load estimation unit 31 considers that the building that exists around the house H1 blocks the solar radiation to the house H1 during the time slot T1 of the day and estimates the heat load which depends on the solar radiation to the house H1 during the time slot T1 of the day to be somewhat low. If the position Pb is not in the direction of the sun during the time slot T1 of the day viewed from the position Ph, the heat load estimation unit 31 considers that the building that exists around the house H1 does not block the solar radiation to the house H1 during the time slot T1 of the day and estimates the heat load which depends on the solar radiation to the house H1 during the time slot T1 of the day to be somewhat high. The estimation method of the heat load is as described above.

The heat load estimation unit 31 may estimate the heat load which depends on the solar radiation for an individual room where an indoor unit of the air conditioner 10 is provided inside the house H1. In such an example, information indicating which way a room R1 in which the indoor unit of the air conditioner 10 is provided inside the house H1 is facing, is included in the house information 43. If the weather forecast for the time slot T1 of the day is sunny, the heat load estimation unit 31 predicts whether or not there is solar radiation to the room R1 during the time slot T1 of the day from the location information 41, the house information 43, and the sun information 44. And, the heat load estimation unit 31 estimates the heat load which depends on the solar radiation to the room R1 during the time slot T1 of the day according to a result of the prediction. The heat load estimation unit 31 may revise an estimation value of the heat load depending on whether or not there is a window in the room R1, and if there is a window, whether or not a curtain is open or not. In such an example, the heat load estimation unit 31 recognizes, from an image of the inside of the room obtained from an infrared sensor or a camera provided in the indoor unit of the air conditioner 10, whether or not there is a window in the room R1, and if there is a window, whether or not a curtain is open or not. Then, if there is no window, the heat load estimation unit 31 estimates the estimation value of the heat load lower compared to when there is a window. When there is a window, but the curtain is closed, the heat load estimation unit 31 estimates the estimation value of the heat load lower compared to when the curtain is open. The heat load estimation unit 31 may adjust the estimation value of the heat load depending on the number of windows or which way the window is facing.

If the weather forecast for the time slot T1 of the day is sunny and a building exists around the house H1, the heat load estimation unit 31 may check whether or not the building blocks the solar radiation to the house H1 during the time slot T1 of the day by taking into consideration not only the position Pb of the building, but also height Hb of the building. In such an example, information indicating height of the building that exists around the house H1 is included in the location information 41. In the sun information 44, information indicating height of the sun is included. Even if the position Pb is in the direction of the sun viewed from the position Ph, if the height Hb is not so high that the sun cannot be seen from the position Ph, the heat load estimation unit 31 considers that the building that exists around the house H1 does not block the solar radiation to the house H1 during the time slot T1 of the day, and estimates the heat load which depends on the solar radiation to the house H1 during the time slot T1 of the day to be somewhat high. The "height of the sun" can, for example, be shown by a solar radiation angle. The solar radiation angle changes depending on seasons such that the angle is 78 degrees during the summer solstice, 55 degrees during the vernal equinox and the autumn equinox, and 32 degrees during the winter solstice. Therefore, by taking information on the solar radiation angle into consideration, the amount of sunlight received can be estimated more accurately.

In this embodiment, the heat load estimation unit 31 only predicts whether or not there is solar radiation to the house H1 during the time slot T1, but as a variation, the heat load estimation unit 31 may predict a solar radiation amount to the house H1 during the time slot T1 by referring to the location information 41 and the weather information 42. In this variation, the heat load estimation unit 31 estimates the heat load which depends on the solar radiation to the house H1 during the time slot T1 according to a result of the prediction. That is, the heat load estimation unit 31 calculates an estimation value of the heat load according to the solar radiation amount predicted.

At step S102, the operation control unit 32 controls ahead, operation of the air conditioner 10 provided in the house H1 before the time slot T1 according to the heat load estimated by the heat load estimation unit 31.

Figure 5:
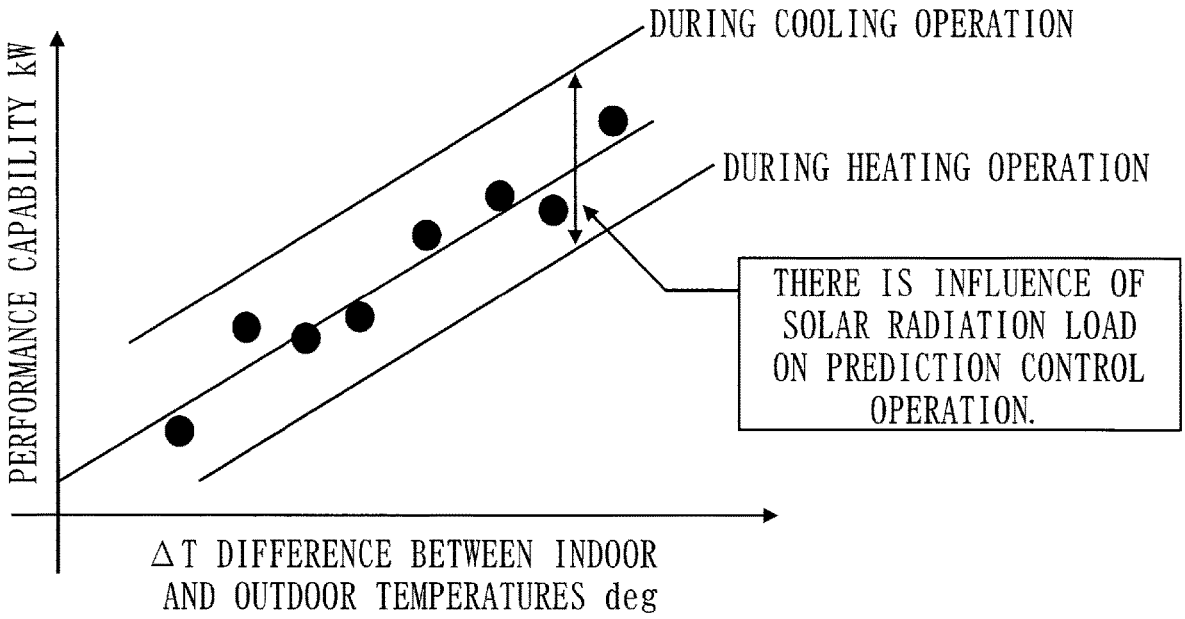
FIG. 5 is a graph illustrating an example of prediction control operation according to a solar radiation load.

Specifically, if the heat load which depends on the solar radiation to the house H1 during the time slot T1 is estimated by the heat load estimation unit 31 to be somewhat high, the operation control unit 32 starts the operation of the air conditioner 10 somewhat earlier before the time slot T1. Or, the operation control unit 32 switches the operation of the air conditioner 10 from low speed operation to high speed operation before the time slot T1. On the other hand, if the heat load which depends on the solar radiation to the house H1 during the time slot T1 is estimated by the heat load estimation unit 31 to be somewhat low, the operation control unit 32 starts the operation of the air conditioner 10 somewhat later before the time slot T1 or will not start before the time slot T1 at least. Or, the operation control unit 32 switches the operation of the air conditioner 10 from high speed operation to low speed operation before the time slot T1 or stops the operation before the time slot T1. An example of prediction control operation according to the heat load which depends on the solar radiation will be illustrated in FIG. 5. Where a performance capability by the air conditioner 10 is Qrac, a heat transmission load is Qa, a heat load which depends on solar radiation is Qβ, and an interior heat gain is Qn, $Qrac=Q\alpha+Q\beta+Qn$. The heat transmission load is proportional to a difference between indoor and outdoor temperatures which is a difference between indoor temperature and outdoor temperature. If there is no heat load which depends on the solar radiation, that is, if $|Q\beta|=0$, where α is a slope of the heat transmission load, the performance capability can be expressed by a linear function where the slope is a and an intercept is Qn. This function can be obtained by plotting a graph with the performance capability in a vertical axis and the difference between indoor and outdoor temperatures in a horizontal axis, and accumulating and analyzing plotted data. As illustrated in FIG. 5, the operation control unit 32 can realize operation that is energy conserving and comfortable without having to wait for feedback from a sensor or a user by offsetting the performance capability by an amount of heat load which depends on the solar radiation if there is a heat load which depends on the solar radiation, that is, if $|Q\beta|>0$.

Similar to conventional art, it is desirable that a connection method of a winding of an electric motor to switch to a star connection during low speed operation and to a delta connection during high speed operation in the compressor 12 of the air conditioner 10. By switching the connection method to a star connection when the compressor 12 is in low speed operation and to a delta connection when the compressor 12 is in high speed operation, integrated electric power consumption can be minimized. If, however, a threshold is defined only by number of rotation of the compressor 12 or by inverter output voltage of the compressor 12, and if a star connection and a delta connection are switched with each other every time the threshold is crossed, operation stop without the user's intention must be made every time the threshold is crossed. Even in a case where an amount of operation time is used as a trigger, stopping of the compressor 12 is made for switching the connection, which leads to increased number of stops of the compressor 12 seen over an entire period, and may deteriorate comfort. Therefore, to have a regular stop timing of the compressor 12 synchronized with a switching timing of the connection to not increase the number of stops of the compressor 12 is desirable for maintaining comfort.

Description of Effect of Embodiment

In this embodiment, the operation of the air conditioner 10 is controlled according to the result of the estimate of the heat load which depends on the solar radiation. Because of this, deterioration of comfort caused by changes in the heat load due to the solar radiation can be reduced.

*Other Configurations*

In this embodiment, the functions of the heat load estimation unit 31 and the operation control unit 32 are realized by software, but as a variation, the functions of the heat load estimation unit 31 and the operation control unit 32 may be realized by hardware. With regard to this variation, mainly the difference from this embodiment will be described.

Figure 6:
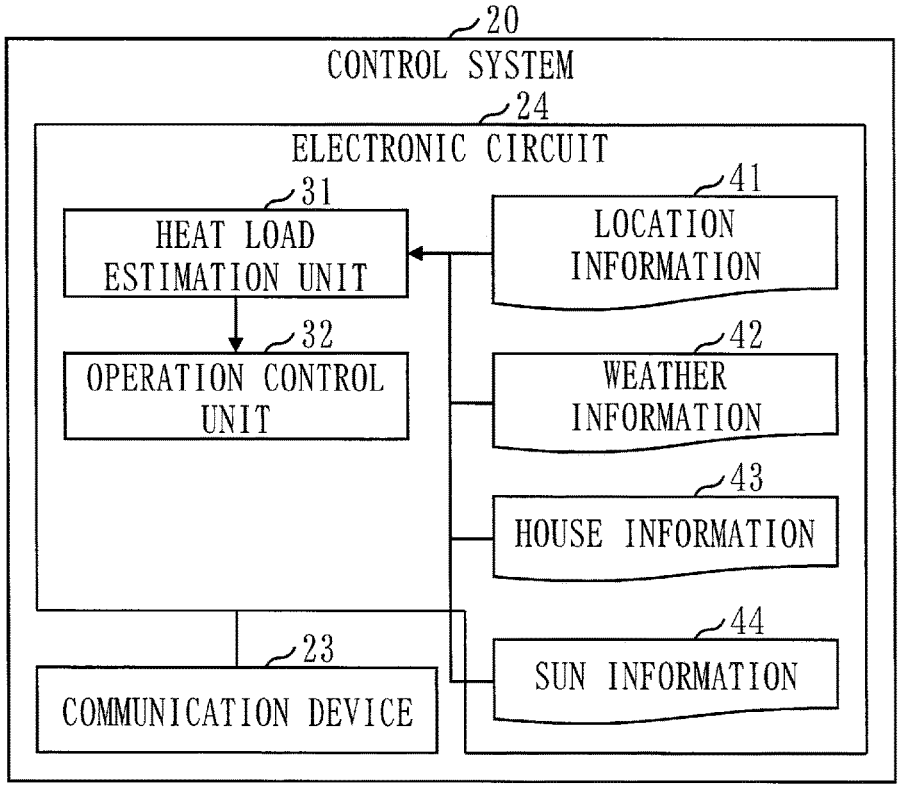
FIG. 6 is a block diagram illustrating a configuration of a control system according to a variation of Embodiment 1.

A configuration of the control system 20 according the variation of this embodiment will be described referring to FIG. 6.

The control system 20 includes hardware such as an electronic circuit 24 and the communication device 23.

The electronic circuit 24 is dedicated hardware that realizes the functions of the heat load estimation unit 31 and the operation control unit 32. The electronic circuit 24 is, for example, a single circuit, a composite circuit, a programmed processor, a parallel programmed processor, a logic IC, a GA, an FPGA, an ASIC, or a combination of some or all of these. "IC" is an abbreviation for Integrated Circuit. "GA" is an abbreviation for Gate Array. "FPGA" is an abbreviation for Field-Programmable Gate Array. "ASIC" is an abbreviation for Application Specific Integrated Circuit.

The control system 20 may include a plurality of electronic circuits that replace the electronic circuit 24. These plurality of electronic circuits realize functions of the heat load estimation unit 31 and the operation control unit 32 as a whole. Each electronic circuit is, for example, a single circuit, a composite circuit, a programmed processor, a parallel programmed processor, a logic IC, a GA, an FPGA, an ASIC, or a combination of some or all of these.

As another variation, the functions of the heat load estimation unit 31 and the operation control unit 32 may be realized by a combination of software and hardware. That is, a part of the functions of the heat load estimation unit 31 and the operation control unit 32 may be realized by dedicated hardware and the rest may be realized by software.

Each of the processor 21 and the electronic circuit 24 is a processing circuitry. That is, even if the configuration of the control system 20 is as the configuration illustrated in either one of FIGS. 3 and 6, operation of the heat load estimation unit 31 and the operation control unit 32 are performed by the processing circuitry.

Embodiment 2

Figure 7:
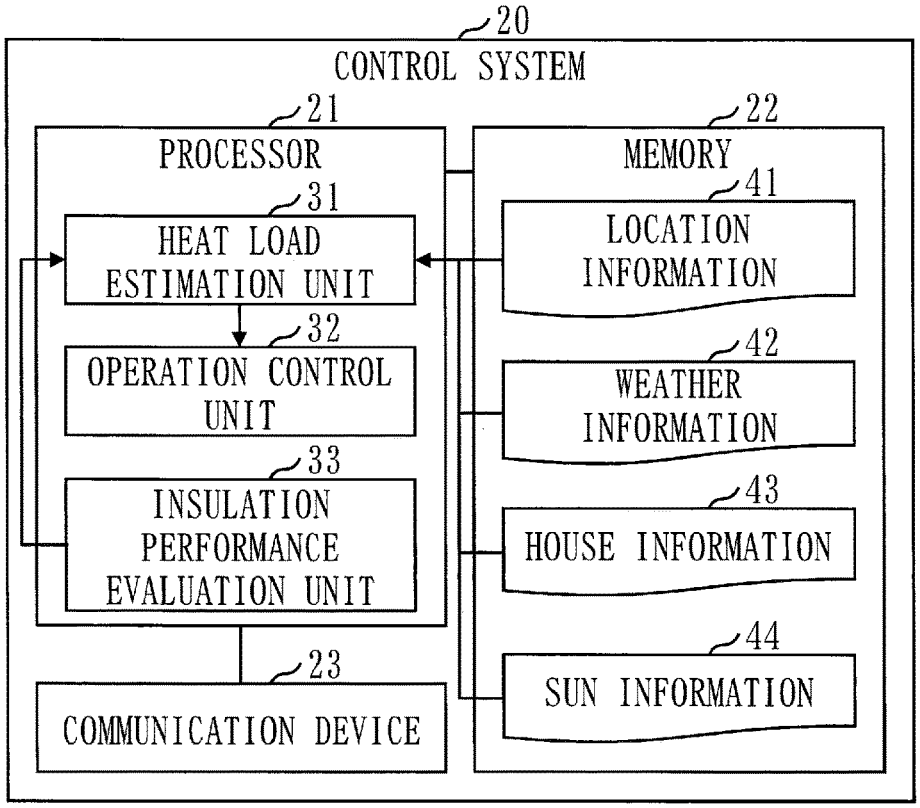
FIG. 7 is a block diagram illustrating a configuration of a control system according to Embodiment 2.
Figure 8:
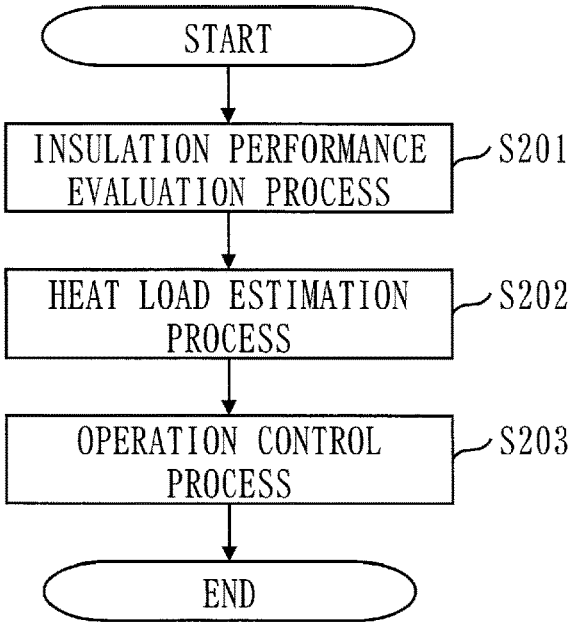
FIG. 8 is a flowchart illustrating operation of a control system according to Embodiment 2.

With regard to this embodiment, difference from Embodiment 1, will mainly be described by using FIGS. 7 and 8.

*Description of Configuration*

Since the configuration of the air conditioner 10 according to this embodiment is the same as that of Embodiment 1, illustrated in FIGS. 1 and 2, the description will be omitted.

A configuration of a control system 20 according to this embodiment will be described by referring to FIG. 7.

In this embodiment, the control system 20 includes, as functional elements, the heat load estimation unit 31, the operation control unit 32, and an insulation performance evaluation unit 33. Functions of the heat load estimation unit 31, the operation control unit 32, and the insulation performance evaluation unit 33 are realized by software. That is, in this embodiment, a control program is a program that realizes functions of the heat load estimation unit 31, the operation control unit 32, and the insulation performance evaluation unit 33.

*Description of Operation*

Operation of the control system 20 according to this embodiment will be described by referring to FIG. 8. The operation of the control system 20 corresponds to a control method according to this embodiment.

At step S201, the insulation performance evaluation unit 33 records capability of the air conditioner 10 and a difference between indoor and outdoor temperatures which is a difference between indoor temperature and outdoor temperature of the house H1 when the air conditioner 10 is in operation. The insulation performance evaluation unit 33 evaluates insulation performance of the house H1 by analyzing relationship between the capability and the difference between indoor and outdoor temperatures recorded.

Figure 9:
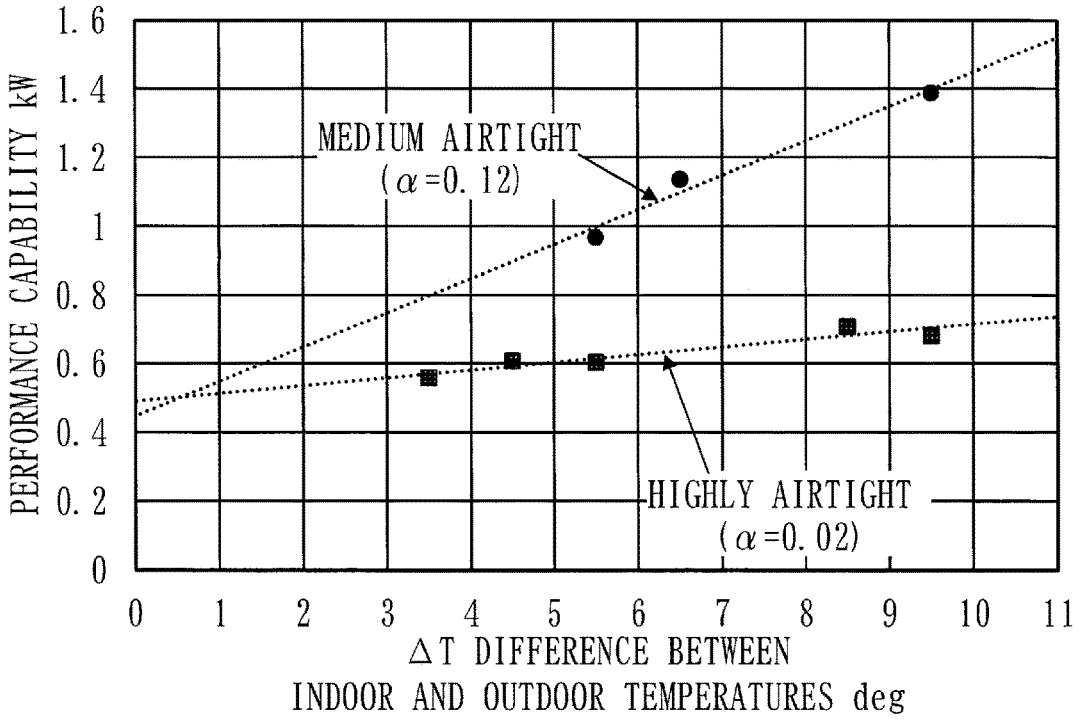
FIG. 9 is a graph illustrating an example of difference in a due to difference in insulation performance.

Specifically, the insulation performance evaluation unit 33 outputs a heat loss coefficient or a heat transmission coefficient, that is, as Q value, a slope a of a linear function that expresses an approximate straight line obtained when plotting a graph with the capacity of the air conditioner 10 when the air conditioner 10 is actually operated in the house H1 as a vertical axis, and the difference between indoor and outdoor temperatures of the house H1 measured by a sensor such as a thermistor at the time of the operation as a horizontal axis. This Q value corresponds to an evaluation value of the insulation performance of the house H1. An example of difference in a due to difference in insulation performance during cooling operation is illustrated in FIG. 9. As can be understood from FIG. 9, a changes depending on the insulation performance.

At step S202, the heat load estimation unit 31, as with step S101 of Embodiment 1., estimates the heat load which depends on the solar radiation to the house H1 during the time slot T1, but at that time, the heat load estimation unit 31 revises an estimation value of the heat load according to a result of the evaluation by the insulation performance evaluation unit 33.

Specifically, when the heat load which depends on the solar radiation to the house H1 during the time slot T1 is to be estimated somewhat high because a weather forecast for the time slot T1 is sunny and the heat load estimation unit 31 checked that there is no building that blocks the solar radiation to the house H1 during the time slot T1, the heat load estimation unit 31 estimates the heat load to be somewhat high, the lower the evaluation value of the insulation performance of the house H1 is.

At step S203, the operation control unit 32, as with step S102 of Embodiment 1., controls ahead, the operation of the air conditioner 10 provided in the house H1 before the time slot T1.

Description of Effect of Embodiment

According to this embodiment, the heat load which depends on the solar radiation can be estimated with higher accuracy.

*Other Configurations*

In this embodiment, as with Embodiment 1., functions of the heat load estimation unit 31, the operation control unit 32, and the insulation performance evaluation unit 33 are realized by software, but as with the variation of Embodiment 1., the functions of the heat load estimation unit 31, the operation control unit 32, and the insulation performance evaluation unit 33 may be realized by hardware. Or, the functions of the heat load estimation unit 31, the operation control unit 32, and the insulation performance evaluation unit 33 may be realized by a combination of software and hardware.

Embodiment 3

Figure 10:
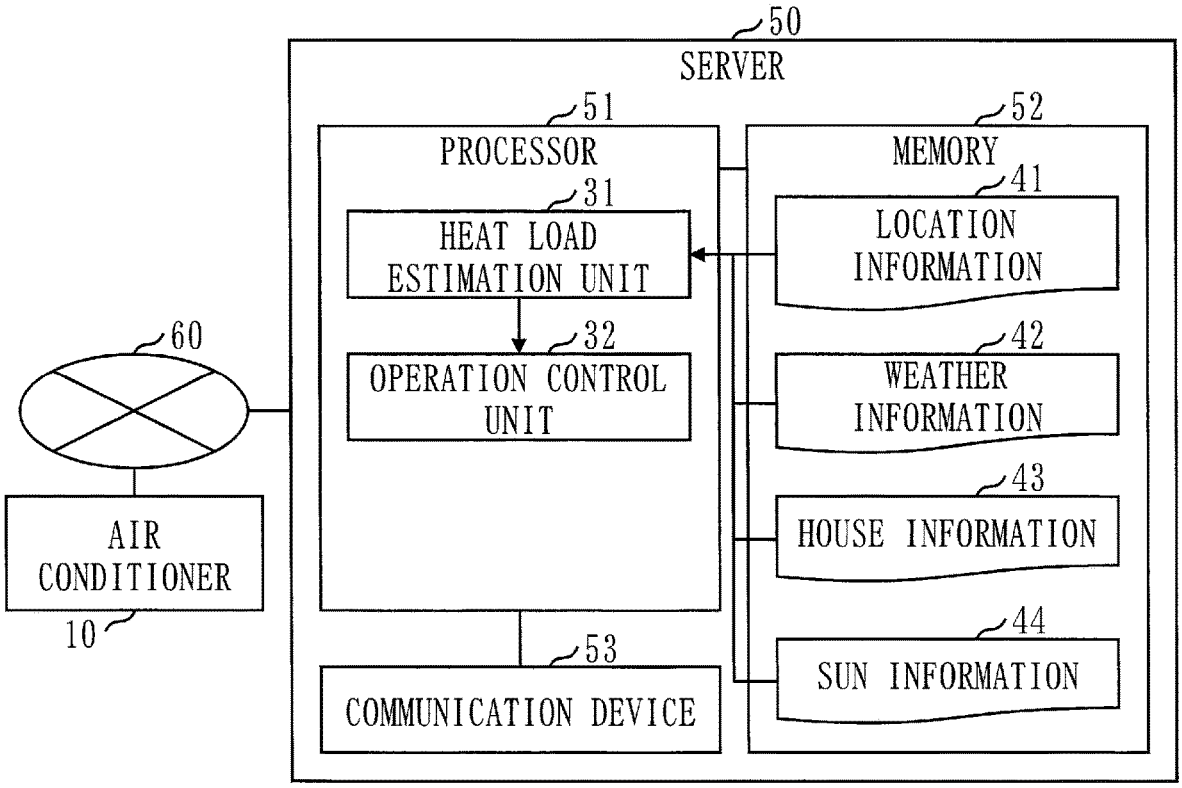
FIG. 10 is a block diagram illustrating a configuration of a control system according to Embodiment 3.

With regard to this embodiment, difference from Embodiment 1, will mainly be described by using FIG. 10.

In Embodiment 1., the air conditioner 10 provided in the house H1 includes the control system 20, but in this embodiment, a server 50 that functions as a control system is provided aside from the air conditioner 10. The server 50 controls operation of the air conditioner 10 via a network 60 such as the Internet.

*Description of Configuration*

A configuration of the server 50 according to this embodiment will be described by referring to FIG. 10.

The server 50 is a computer. The server 50 is, specifically, a cloud server. The server 50 includes a processor 51 along with other hardware such as a memory 52 and a communication device 53. The processor 51 is connected to other hardware via signal lines and controls these other hardware.

The server 50 includes, as functional elements, the heat load estimation unit 31 and the operation control unit 32. Functions of the heat load estimation unit 31 and the operation control unit 32 are realized by software.

The processor 51 is a device that executes the control program. The control program is, as with that of Embodiment 1., a program that realizes functions of the heat load estimation unit 31 and the operation control unit 32.

The memory 52 is a device that stores the control program. The memory 52 is, for example, a RAM, a flash memory, or a combination of these.

The location information 41, the weather information 42, the house information 43, and the sun information 44 are stored in the memory 52.

The communication device 53 includes a receiver that receives data inputted into the control program and a transmitter that transmits data outputted from the control program. The communication device 53 is, for example, a communication chip or an NIC.

The control program is read into the processor 51 from the memory 52, and is executed by the processor 51. Not only the control program, but also an OS is stored in the memory 52. The processor 51 executes the control program while executing the OS. A part or all of the control program may be built into the OS.

The control program and the OS may be stored in an auxiliary storage device. The auxiliary storage device is, for example, an HDD, a flash memory, or a combination of these. "HDD" is an abbreviation for Hard Disk Drive. If the control program and the OS are stored in the auxiliary storage device, the control program and the OS are loaded into the memory 52 and executed by the processor 51.

The server 50 may include a plurality of processors that substitute for the processor 51. These plurality of processors share the execution of the control program. Each processor is, for example, a CPU.

Data, information, signal values, and variable values used, processed, or outputted by the control program are stored in the memory 52, the auxiliary storage device, or in a register or a cache memory in the processor 51.

The server 50 may be configured of one computer or may be configured of a plurality of computers. If the server 50 is configured of a plurality of computers, functions of the heat load estimation unit 31 and the operation control unit 32 may be realized by being distributed to each computer.

Similar to the control system 20 according to Embodiment 2, the server 50 may further include the insulation performance evaluation unit 33 as a functional element.

*Description of Operation*

As for operation of the server 50 according to this embodiment, the description will be omitted since the operation is the same as the operation of the control system 20 according to Embodiment 1, except for a point where the server 50 controls the operation of the air conditioner 10 by communicating with the air conditioner 10.

*Other Configurations*

In this embodiment, functions of the heat load estimation unit 31 and the operation control unit 32 are realized by software, but as a variation, the functions of the heat load estimation unit 31 and the operation control unit 32 may be realized by a combination of software and hardware. That is, a part of the functions of the heat load estimation unit 31 and the operation control unit 32 may be realized by dedicated hardware and the rest may be realized by software.

In this embodiment, the heat load estimation unit 31 and the operation control unit 32 are included in the server 50, but as a variation, the heat load estimation unit 31 and the operation control unit 32 may be distributed among the server 50 and the air conditioner 10. That is, instead of the server 50 functioning as the control system, the server 50 and the air conditioner 10, as a whole, may function as the control system.

The invention claimed is:

1. A control system comprising:

processing circuitry to:

by referring to location information that indicates a location environment of a house and to weather information that indicates a weather forecast for a certain time slot, check whether or not there is a building that blocks solar radiation to the house during the time slot based on the location information when the weather forecast indicated in the weather information is sunny, and estimate a heat load which depends on solar radiation to the house during the time slot according to a result of the check, wherein a first standard value of a heat load is used as the estimated heat load when the solar radiation is predicted to be high, and a second standard value of a heat load is used as the estimated heat load when the solar radiation is predicted to be low, and the processing circuitry is further configured to control ahead operation of an air conditioner provided in the house before the time slot according to the heat load estimated.

2. The control system according to claim 1, wherein the location information includes information that indicates a position of a building that exists around the house, and the processing circuitry checks whether or not there is a building that blocks the solar radiation to the house during the time slot when the weather forecast indicated in the weather information is sunny, by referring to house information that indicates a position of the house and to sun information that indicates a direction of the sun in the time slot, other than the location information.

3. The control system according to claim 2, wherein the house information includes information that indicates which way a room in which an indoor unit of the air conditioner is provided inside the house is facing, and the processing circuitry predicts whether or not there is solar radiation to the room during the time slot when the weather forecast indicated in the weather information is sunny, based on the location information, the house information, and the sun information, and estimates a heat load which depends on the solar radiation to the room during the time slot according to a result of the prediction.

4. The control system according to claim 2, wherein the location information includes information indicating height of a building that exists around the house, and the sun information includes information indicating height of the sun.

5. The control system according to claim 1, wherein the processing circuitry predicts a solar radiation amount to the house during the time slot by referring to the location information and the weather information, and estimates the heat load which depends on the solar radiation to the house during the time slot according to a result of the prediction.

6. The control system according to claim 1 wherein:

the processing circuitry records capability of the air conditioner and a difference between indoor and outdoor temperatures which is a difference between indoor temperature and outdoor temperature of the house when the air conditioner is in operation, and to evaluate insulation performance of the house by analyzing relationship between the capability and the difference between indoor and outdoor temperatures recorded, and the processing circuitry revises an estimation value of the heat load which depends on the solar radiation to the house during the time slot according to a result of the evaluation performed.

7. A control system comprising:

processing circuitry to:

by referring to location information that indicates a location environment of a house and to weather information that indicates a weather forecast for a certain time slot, estimate a heat load which depends on solar radiation to the house during the time slot, wherein a first standard value of a heat load is used as the estimated heat load when the solar radiation is predicted to be high, and a second standard value of a heat load is used as the estimated heat load when the solar radiation is predicted to be low, and the processing circuitry is further configured to control ahead operation of an air conditioner provided in the house before the time slot according to the heat load estimated, and record capability of the air conditioner and a difference between indoor and outdoor temperatures which is a difference between indoor temperature and outdoor temperature of the house when the air conditioner is in operation, and to evaluate insulation performance of the house by analyzing relationship between the capability and the difference between indoor and outdoor temperatures recorded, wherein the processing circuitry revises an estimation value of the heat load which depends on the solar radiation to the house during the time slot according to a result of the evaluation performed.

8. An air conditioner comprising:

the control system according to claim 1.

9. A server which is the control system according to claim 1, to control operation of the air conditioner via a network.

* * * * *